United States Patent [19]

Nishijima

[11] Patent Number: 4,667,355

[45] Date of Patent: May 26, 1987

[54] STRETCHER

[76] Inventor: Takeshi Nishijima, 1-banchi, Okayama-cho, Wakaya-shi, Wakayama-ken, Japan

[21] Appl. No.: 872,234

[22] Filed: Jun. 9, 1986

[30] Foreign Application Priority Data

Jun. 10, 1985 [JP] Japan ..... 60-87227

[51] Int. Cl.[4] ..... A61G 1/00

[52] U.S. Cl. ..... 5/82 R; 5/81 R

[58] Field of Search ..... 5/82 R, 82 B, 81 C, 5/81 B, 81 R; 414/921, 757, 781

[56] References Cited

U.S. PATENT DOCUMENTS

| | | | |
|---|---|---|---|
| 2,880,427 | 4/1959 | Atwood | 5/82 |
| 2,903,043 | 9/1959 | Kenney | 5/81 B |
| 2,918,681 | 12/1959 | Davis | 5/81 C |
| 2,984,842 | 5/1961 | Richards | 5/82 |
| 3,775,784 | 12/1973 | Fry | 5/82 X |
| 3,781,929 | 1/1974 | Stevens | 5/86 X |
| 3,810,263 | 5/1974 | Taylor et al. | 5/81 R |
| 3,886,605 | 6/1975 | Harris | 5/81 R |
| 3,967,328 | 7/1976 | Cox | 5/81 R |

FOREIGN PATENT DOCUMENTS

| | | | |
|---|---|---|---|
| 219736 | 3/1910 | Fed. Rep. of Germany | 5/82 |
| 2809526 | 9/1979 | Fed. Rep. of Germany | 5/81 R |
| 116904 | 6/1961 | U.S.S.R. | 5/81 R |

*Primary Examiner*—Thomas J. Holko
*Assistant Examiner*—Carl M. DeFranco, Jr.
*Attorney, Agent, or Firm*—Koda and Androlia

[57] ABSTRACT

A stretcher for moving an injured or sick person, that includes an approximately life size and flat body holder board, two frame poles serving as handles, four supporting arms for supporting the ends of the frame poles, short frame members into which the supporting arms are inserted, and a face cover, formed in an endless loop in cross-section wrapped around said frame poles.

5 Claims, 5 Drawing Figures

STRETCHER

BACKGROUND OF THE INVENTION

1. Field of the Invention

The present invention relates to a stretcher used for carrying and moving an injured or sick person or a dead body.

2. Prior Art

Stretchers in conventional use include various types, such as those to be carried by men, which are constructed using short frames interposed between two mutually parallel frame bars with tent cloth stretched over them, or those which are to be rolled on wheels.

In all of the abovementioned conventional stretchers, when, for example, an injured or sick person is to be placed on the stretcher, the injured or sick person must be lifted manually. Accordingly, it is impossible to move the injured or sick person onto the stretcher without causing a shock to the injured or sick person and many people's hands are required to do the job. Also, even when the job is done by plural number of people, it is difficult to lift the wounded or sick person with uniform force, and it is inevitable to cause some shocks to the injured or sick person. As a result, nursing staff, etc. who also serve as carriers, have to make strenuous efforts in taking care of the person to be carried, thus being forced to do heavy physical and mental labor.

SUMMARY OF THE INVENTION

The present invention is intended to eliminate all of the foregoing disadvantages of conventional stretcher, and an object of this invention is to provide a stretcher capable of having the injured or sick peson placed on it smoothly, by rotating the frame poles after the stretcher is inserted slightly under the side of the injured or sick person.

The abovementioned object of this invention is achieved by providing the stretcher with the following structure. That is, the stretcher includes a body holder board, two frame poles, four supporting arms, short frame members, and a face cover.

The body holder board is nearly life size and has a flat center base board, and has guiding protrusions formed at specified pitch intervals along the longitudinal side edge of this center base board. A plural number of intermediate covers are wound over the center base board between the guiding protrusions in a manner to be rotatable optionally in a transverse direction, without causing any mutual overlapping.

Both end portions of each of the two frame poles are made into handles, while the middle portion is made into a belt-driving surface, with elastic tubes wound over and covering it at certain intervals.

Each of the four supporting arms has a connecting arm portion provided with connecting travel adjusting holes, and a bearing portion that is combined with each supporting arm to form an integral unit.

The short frame member includes a frame bas having at both ends hollow portions whereto the connecting arm portions are inserted. This frame base is provided with elongated holes for adjusting the interval, and also with supporting feet which can be tilted optionally.

The face cover is cylindrical in form, and it is provided, along its inner surface, with a member that corresponds to and engages with the belt-driving surfaces of the frame poles, and that is adhered to the inner surface of the face cover to form an integral unit.

In the stretcher thus constructed, on both end surface of the body holder board, the short frame members are fixed and held. Also, into the hollow portions of the short frame members, the supporting arms are inserted and fixed. By the shaft bearings of the supporting arms, the frame poles are held in an optionally rotatable manner, by extending the handles at both end portions. The body holder board and the frame poles are covered by the face cover, and the frame poles engage with the face cover.

The stretcher according to this invention, that has the structure as mentioned above, is operated as follows.

An injured or sick person who is in a lying position is turned sideways slightly, at the same time, by using the supporting feet of the stretcher provided by this invention as fulcrums, the stretcher is tilted so that the frame poles come down. Then, by placing a frame pole side under the back of the injured or sick person, the face cover is brought into contact with the back of the person to be carried. In this manner, a part of the body weight of the injured or sick person is supported by the body holder board through the face cover. Thereafter, when the handles are rotated, the face cover, in the state of being lifted up by the supporting feet, moves by means of the engaging belts that engage with the gears, etc. which in turn are combined with the handles to form the integral units. As a result, the injured or sick person is moved by his or her own body weight and the contact resistance of the face cover, thereby becoming mounted on the body holder board. Then, the stretcher with the injured or sick person mounted on it is moved as it is with its handles gripped by men, or is mounted on a wheeled frame or bed, etc. For dismounting the injured or sick person from the stretcher, by taking the steps opposite to the previously mentioned operation, after tilting the stretcher carrying the injured or sick person on it, the face cover is moved in the direction to dismount the injured or sick person, by rotating the handles.

As has been described above, the stretcher according to this invention does not require mounting or dismounting of the injured or sick person onto or from it by directly lifting the body of the injured or sick person when moving him or her. Consequently, the injured or sick person can be moved easily without requiring the help of many nursing staff. Also, the injured or sick person who is lying on his or her back is merely turned sideways. Therefore, the injured or sick person is not forcibly required to change his or her body position. Thus, the person to be carried does not need to go through a harsh or painful experience, and the aggravation of symptoms is not invited. In addition, the mental and physical strains and heavy labor of the nursing staff can be reduced a great deal.

The other objects and advantages will become apparent from the description given below.

BRIEF DESCRIPTION OF THE DRAWINGS

The drawings show a stretcher as an embodiment of this invention wherein like reference numerals denote like elements and in which.

DETAILED DESCRIPTION OF THE INVENTION

Figure 1:
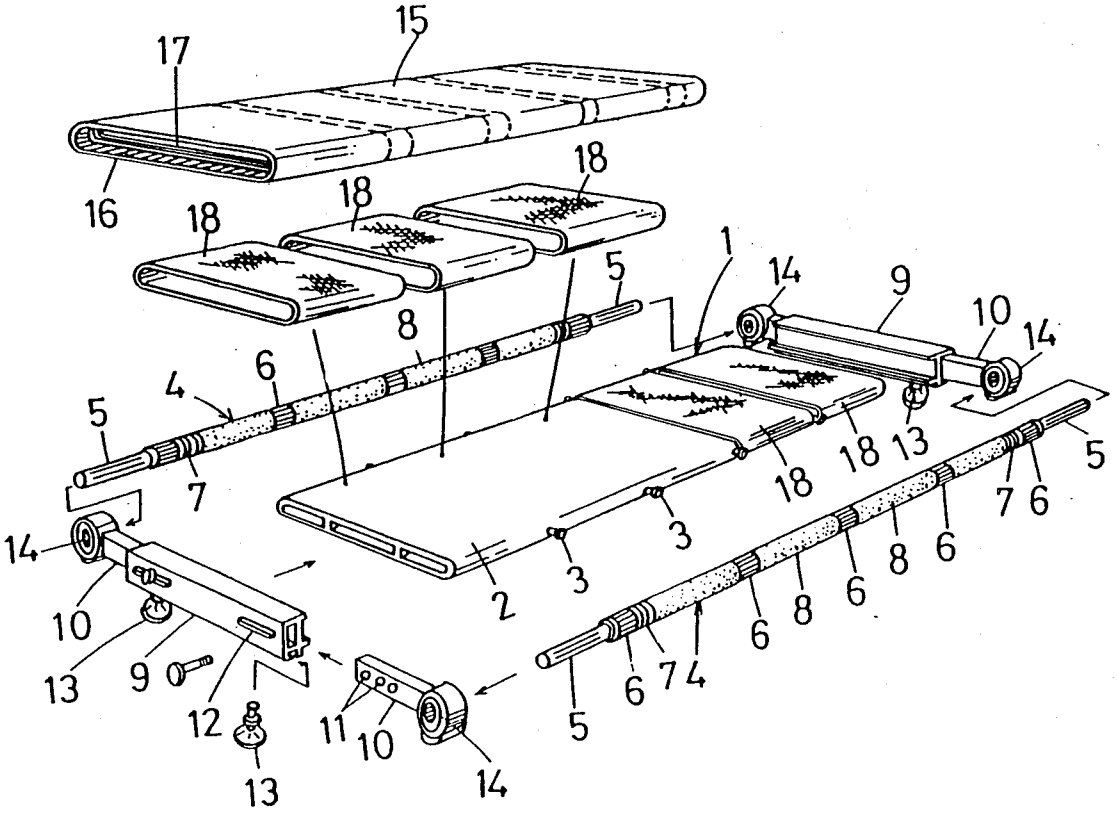
FIG. 1 is an exploded perspective view.
Figure 2:
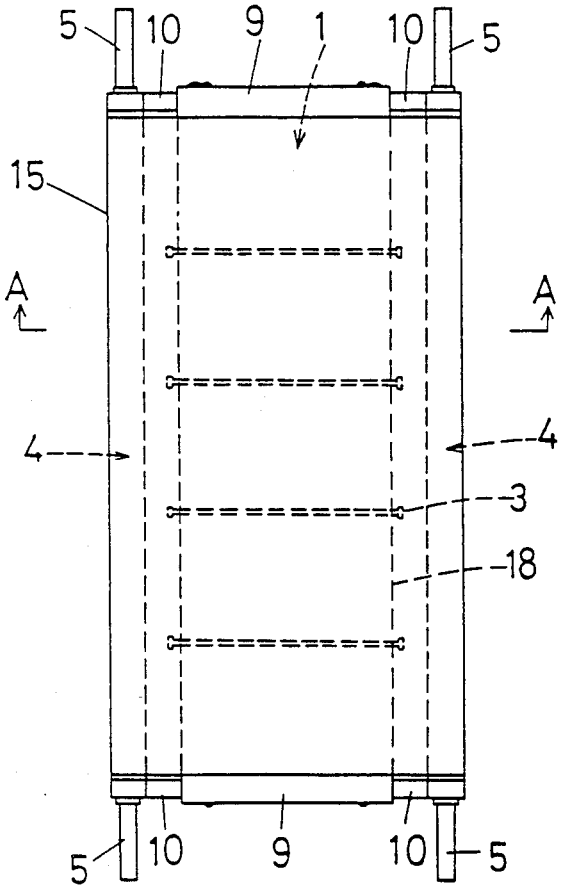
FIG. 2 is a plan view of a finished product.
Figure 3:
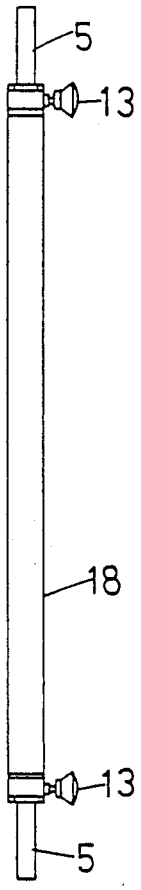
FIG. 3 is a side view thereof.
Figure 4:
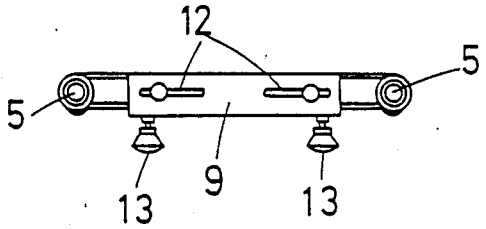
FIG. 4 is a front view thereof.

In the drawings, that denoted by 1 is a body holder board. In this body holder board 1, along the longitudinal side edge of a center base board 2, which is formed to be approximately life-size and which includes a flat hollow body made of light-weight aluminum, synthetic resin, etc., are provided rivets which function as guiding protrusions 3 at specified intervals, and a large number of intermediate covers 18, which rotate by using the guiding protrusions 3 as a guide, are wound on the center base board 2.

Those denoted by 4 are two frame poles. These frame poles 4 are longer than the body holder board 1 by a length equivalent to the portion of the handles 5 formed at both ends. To the middle part of the frame pole 4, gears 6 are fixed at specified intervals, and at locations adjoining to gears 6 closest to the handles 5, grooved pulleys 7 are also fixed. Between these gears 6, or between the gears 6 and grooved pulleys 7, elastic cylinders 8 made of sponge are disposed such that they wind around the frame poles 4.

Those represented by 9 are short frame members which are held by and fixed to both end surfaces of the body holder board 1. Into the open ends of the hollows formed in both end portions of the short and fixed frame members 9, supporting arms 10 are inserted and fixed, respectively. For fixing by insertion, several connecting interval adjusting holes 11 formed in the supporting arms 10 are fit to elongated holes 12 formed in the short frame members 9, and screws are used for fixing the two together. To the undersides of the short frame members 9, pull-aparts which are freely inclinable supporting feet 13 are attached.

The abovementioned frame poles 4 are held by the supporting arms 10 connected to the short frame members 9, in an optionally rotatable manner. The holding mentioned above is effected as follows. That is, bearings are used for the shaft receiving parts 14 formed at one end respectively of the supporting arms 10 for supporting the frame poles 4.

That designated by 15 is a face cover that is wound over and covers the body holder board 1 and the frame poles 4 provided in parallel with the body holder board 1. In order to effect the engagement between the engaging belts 16 and grooves belts 17 integrally adhered to the inner surface of the face cover 15 and the gears 6 and the grooved pulleys 7 of the frame poles 4, the assembly is made stretching the face cover 15 by adjusting the connection between the supporting arms 10 and the frame member 9.

Figure 5:
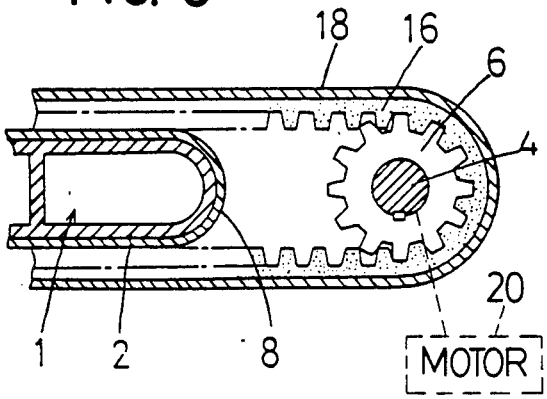
FIG. 5 is an enlarged sectional view taken along the line A—A in FIG. 2.

In the embodiment described above, the frame poles 4 are designed to be rotated manually, but an electric motor 20 which is shown in dashed lines in FIG. 5, such as a small size battery-driven motor, may be installed for this use.

Also, belts for tying the injured or sick person may be provided from the short frame members 9, and safety shoulder straps may be provided for the handles, for further improving the safeguarding performance. Or, a highly water resistant material may be used for the component members, so that the stretcher can be submerged as it is in a bath tub, etc.

Furthermore, to the undersides of the short frame members 9, instead of the abovmentioned pull-aparts, supporting feet with their right and left lower angled portions formed to have convex surfaces for making it easy to tilt to the right and left may be fixed.

What is claimed is:

1. A stretcher for carrying an injured or sick person comprising:

a body holder board including a center base board that is about life-size and flat along its longitudinal side edges, guiding protrusions are formed at specified pitch intervals, and also including a plurality of intermediate covers which are wound around in a freely rotatable manner in a transverse direction over the center base board to cover it without overlapping;

two frame poles which are formed with handles at both their end portions, while their middle portions are formed with belt-driving surfaces with elastic tubes (cylinders) covering them at predetermined intervals;

four supporting arms including connecting arms which are provided with connecting interval adjusting holes, and bearing formed as integral parts respectively at each end of the supporting arms;

short frame members formed of frame bases having hollows at both end portions for inserting the supporting arms into them and also provided with freely inclinable supporting feet;

a cylindrical face cover with members for engaging with the belt-driving surfaces of the frame poles by corresponding to them which are adhered to an inner surface of the face cover to form an integral unit; and wherein:

the short frame membes are fixed to and held by both end surfaces of the body holder board;

into the hollowed portions of the short frame members, the supporting arms are inserted and fixed;

by means of the bearings of the supporting arms, the frame poles are freely rotatably held by extending the handles at both their end portions through the bearing; and the body holder board and the frame poles are covered by the face cover, whereby effecting the engagement between the frame poles and the face cover.

2. The stretcher as defined in claim 1, wherein each of said two frame poles is constructed by disposing gears and grooved pulleys at both ends of the elastic tubes of the frame pole.

3. The stretcher as defined in claim 1, further comprising an electric motor for driving said two frame poles to rotate.

4. The stretcher as defined in claim 2, wherein said body holder board is formed of a hollow unit made of an aluminum alloy.

5. The stretcher as defined claim 2, wherein said body holder board is constructed of a hollow unit made of synthetic resin.

* * * * *